US008316754B2

(12) United States Patent
Gugliada

(10) Patent No.: US 8,316,754 B2
(45) Date of Patent: Nov. 27, 2012

(54) SHORT RECOIL FIRE-ARM

(76) Inventor: Giovanni Gugliada, Voghera (IT)

( * ) Notice: Subject to any disclaimer, the term of this patent is extended or adjusted under 35 U.S.C. 154(b) by 124 days.

(21) Appl. No.: 13/051,334

(22) Filed: Mar. 18, 2011

(65) Prior Publication Data

US 2011/0232473 A1 Sep. 29, 2011

(30) Foreign Application Priority Data

Mar. 23, 2010 (IT) ..... MI2010A0474

(51) Int. Cl.
*F41A 3/40* (2006.01)

(52) U.S. Cl. ..... 89/162; 42/1.06; 89/1.7

(58) Field of Classification Search ..... 89/160–178, 89/1.7–1.703; 42/1.06
See application file for complete search history.

(56) References Cited

U.S. PATENT DOCUMENTS

| | | | | |
|---|---|---|---|---|
| 1,057,329 | A | 3/1913 | Clarus | |
| 1,071,023 | A | 8/1913 | Borchardt | |
| 1,431,979 | A * | 10/1922 | Pomeroy | 89/170 |
| 2,627,686 | A * | 2/1953 | Shockey | 42/1.06 |
| 2,952,088 | A | 9/1960 | Ivy | |
| 3,088,378 | A * | 5/1963 | Boudreau | 89/161 |
| 3,901,125 | A * | 8/1975 | Raville | 89/163 |
| 5,050,480 | A * | 9/1991 | Knight et al. | 89/147 |
| 5,734,120 | A * | 3/1998 | Besselink | 89/163 |
| 7,617,758 | B2 * | 11/2009 | Gavage et al. | 89/161 |
| 2003/0200692 | A1 * | 10/2003 | Lakatos et al. | 42/1.06 |
| 2008/0173168 | A1 | 7/2008 | Gussalli Beretta | |
| 2011/0232473 | A1 * | 9/2011 | Gugliada | 89/162 |
| 2012/0085225 | A1 * | 4/2012 | Vanek | 89/163 |

FOREIGN PATENT DOCUMENTS

| | | |
|---|---|---|
| EP | 1 950 520 A1 | 7/2008 |
| GB | 09914 A | 0/1913 |

* cited by examiner

*Primary Examiner* — Samir Abdosh
(74) *Attorney, Agent, or Firm* — Pearne & Gordon LLP

(57) ABSTRACT

The present invention relates to a short recoil firearm (1) comprising a main body (2); a barrel (7) slidingly mounted on the main body (2) and movable between a forward percussion position and a backward recoil position; a slider (17) slidingly mounted on the main body (2) and movable between a forward position of closure of the barrel (7) and a backward stop position. The firearm (1) further comprises a plurality of cylindrical rollers (22) operatively connected to a spirally wound tape spring (26). The cylindrical rollers are movable between a first configuration, in which they lie mutually side by side between the slider (17) and the barrel (7), to prevent the relative movement thereof and to allow the integral displacement of same, and a second configuration, in which they lie in a recovery chamber (27). During passage from the first configuration towards the second configuration, the displacement of the barrel (7) opens an access (27*a*) for entrance of the cylindrical rollers (22) into the recovery chamber (27), causing disengagement between the barrel (7) and the slider (17). During passage from the second configuration towards the first configuration, the tape spring (26) brings the pushing elements (22) back to the first configuration through said access (27*a*).

10 Claims, 2 Drawing Sheets

X–X
Y–Y
Z–Z

SHORT RECOIL FIRE-ARM

FIELD OF THE INVENTION

The present invention relates to a short recoil firearm. In particular, the present invention falls within the field of semi-automatic light firearms such as pistols or rifles employed in the military or sports field (e.g. hunting, target-shooting), with projectiles, large shots, shot cartridges, etc.

BACKGROUND OF THE INVENTION

It is known that there are semiautomatic firearms (i.e. capable of recalling the movable masses after the shot, ejecting the cartridge case and loading new ammunitions) in which the breechblock and the barrel carry out different recoil strokes following expansion of the gases generated by the explosion. The barrel slides backwards together with the breechblock over a first portion, of smaller extent, and then stops and the breechblock continues its stroke over a second portion, of greater extent, being disengaged from the barrel. Barrel and breechblock are brought back to the percussion position by suitable return springs. During the return travel, the breechblock causes ejection of the cartridge case and loading of a new ammunition in the barrel.

In this regard, the public document EP 1 950 520 discloses a semiautomatic smooth-bore rifle comprising a frame provided with breech, a barrel slidably mounted on the frame relative to the breech, a breechblock-slider assembly that is slidable relative to the breech, and elastic means comprising a friction spring, which means is able to oppose the translational motion of said barrel.

The Applicant has felt the need to improve the movement mechanism of the barrel and the breechblock in semi-automatic short recoil firearms first of all for ensuring a greater liability and a smaller wear of the parts carrying out a relative motion.

In fact, the Applicant has noticed that during separation between barrel and breechblock in the recoil movement and/or recoupling of these elements during return to the percussion position, the contact between the parties in motion can lead to a quick wear of the parts, giving rise, as a result, to possible seizing.

In addition, the usually helical springs that are employed for return of the barrel and/or breechblock or for damping the impulse movements of said barrel and/or breechblock can be subjected to yield, over a long period of use. As a result, the accuracy and functional qualities of the arm are compromised.

In this context, the technical task underlying the present invention is to propose a short recoil firearm overcoming the aforesaid drawbacks of the known art.

In particular, it is an object of the present invention to propose a short recoil firearm capable of ensuring movement accuracy of the parts over time, the efficiency of same being maintained substantially unchanged.

In greater detail, the present invention aims at making available a short-recoil firearm ensuring a joined and integral movement of the barrel and breechblock during a first portion of the recoil stroke and a guided decoupling of the breechblock from the barrel during a second portion of the recoil stroke.

SUMMARY OF THE INVENTION

The technical task mentioned and the aims specified are substantially achieved by a short recoil fire arm in which coupling between barrel and breechblock is obtained through a train of movable cylindrical rollers and a spirally-wound tape spring.

More specifically, in a first aspect, the present invention relates to a short recoil firearm, comprising:

- a main body;
- a barrel comprising a tubular body having a proximal opening and a distal opening; said barrel being slidably mounted on the main body and movable between a forward percussion position and a backward recoil position;
- a slider slidably mounted on the main body and movable between a forward position of closure of the barrel and a backward stop position;
- elastic means working on the slider to push said slider towards the forward closure position;

characterised in that it comprises a plurality of pushing elements operatively connected to the elastic means and movable between a first configuration, in which they lie mutually side by side along an operative direction between the slider and the barrel, to prevent the relative movement between said barrel and slider and to allow the integral displacement of said barrel with said slider, and a second configuration, in which they lie in a recovery chamber placed on the side of said operative direction; wherein, during passage from the first configuration towards the second configuration, the barrel displacement opens an access for entrance of the pushing elements into said recovery chamber, and wherein, during passage from the second configuration towards the first configuration, the elastic means forces said pushing elements towards said first configuration through said access.

The above described solution enables the relative movement between barrel and slider, while at all events maintaining, during this relative movement, a continuous mechanical coupling between said two elements through the pushing elements.

Preferably, said pushing elements comprise a plurality of cylindrical rollers disposed mutually side by side at their cylindrical surfaces. The rollers are of simple and sturdy construction and, through their sliding/rolling, ensure a smooth movement of the mechanism without any risk of seizing.

Preferably, the elastic means comprises a spirally wound tape spring connected to an end pushing element operatively connected to said plurality of pushing elements; wherein in the first configuration said end pushing element is positioned in said access. The tape spring keeps its elastic features over time without yielding, thus ensuring a constant and accurate operation of the firearm.

Preferably, the recovery chamber is shaped as an arc of a circle and, preferably, partly extends around the tape spring. The resulting structure is simple and compact.

Preferably, an operating portion of the slider slides alongside the tubular body of the barrel and is aligned with, and faces a radial portion of the barrel along the operating direction; wherein the pushing elements, at least in the first configuration, are placed between said radial portion of the barrel and said operating portion of the slider. The mechanism is positioned on the side of the barrel and is not bulky for the user.

Preferably, said radial portion of the barrel has a stop plane and the end pushing element has a stop surface; wherein, in the first configuration, the stop plane rests against said stop surface. Coupling between the barrel and the end element on said plane ensures safe locking of the elements in the return movement to the percussion position and fully closes access to the recovery chamber.

Preferably, the stop plane is inclined to an in/out direction of the access, to facilitate entry of the pushing elements in said recovery chamber or exit of the pushing elements from said recovery chamber; wherein the pushing elements during passage between the first and second configuration push against said stop plane, keeping the barrel in the backward recoil position.

Preferably, the firearm comprises an adjusting device operatively working on the tape spring to adjust the preload of said tape spring. The force exerted by the spring can be adjusted based on the features of the projectiles used.

Preferably, the firearm comprises a lock device placed nearby the access and movable between a disengaged position from said access, to allow entry or exit of the pushing elements, and an engaged position in said access, to lock the pushing elements when they are in said recovery chamber and to help disassembling of the arm.

Separation of the barrel from the support body can therefore be carried out without the risk that the rollers may fall out of the recovery chamber.

BRIEF DESCRIPTION OF THE DRAWINGS

Further features and advantages of the present invention will become more apparent from the description given by way of non-limiting example of a preferred but not exclusive embodiment of a short recoil firearm, as shown in the accompanying drawings, in which.

DETAILED DESCRIPTION OF PREFERRED EMBODIMENTS OF THE INVENTION

Figures 1, 3:
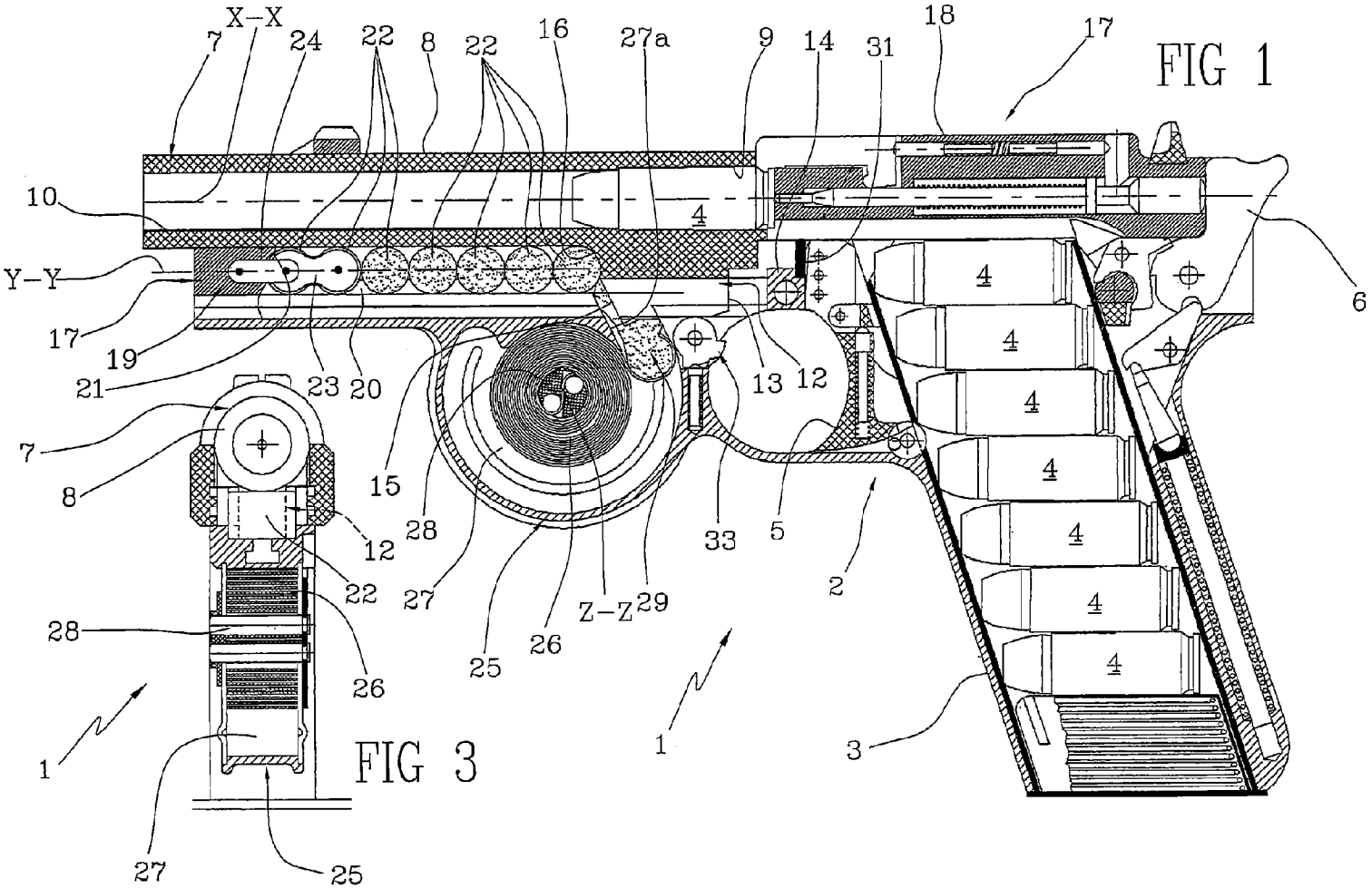
FIG. 1 is a diagrammatic sectional view of a semiautomatic short recoil pistol according to the present invention, in an operating configuration.
FIG. 3 is a partial front view of the pistol in FIG. 1.

In the accompanying drawings, a firearm that in the non-limiting example is a pistol or hand gun, has been identified with reference numeral 1.

Pistol 1 comprises, in known manner and therefore not described in detail, a main body or frame 2 provided with a grip 3 that also performs the function of projectile 4 housing, and a trigger 5 operatively connected to a hammer 6.

Figures 2, 4, 5:
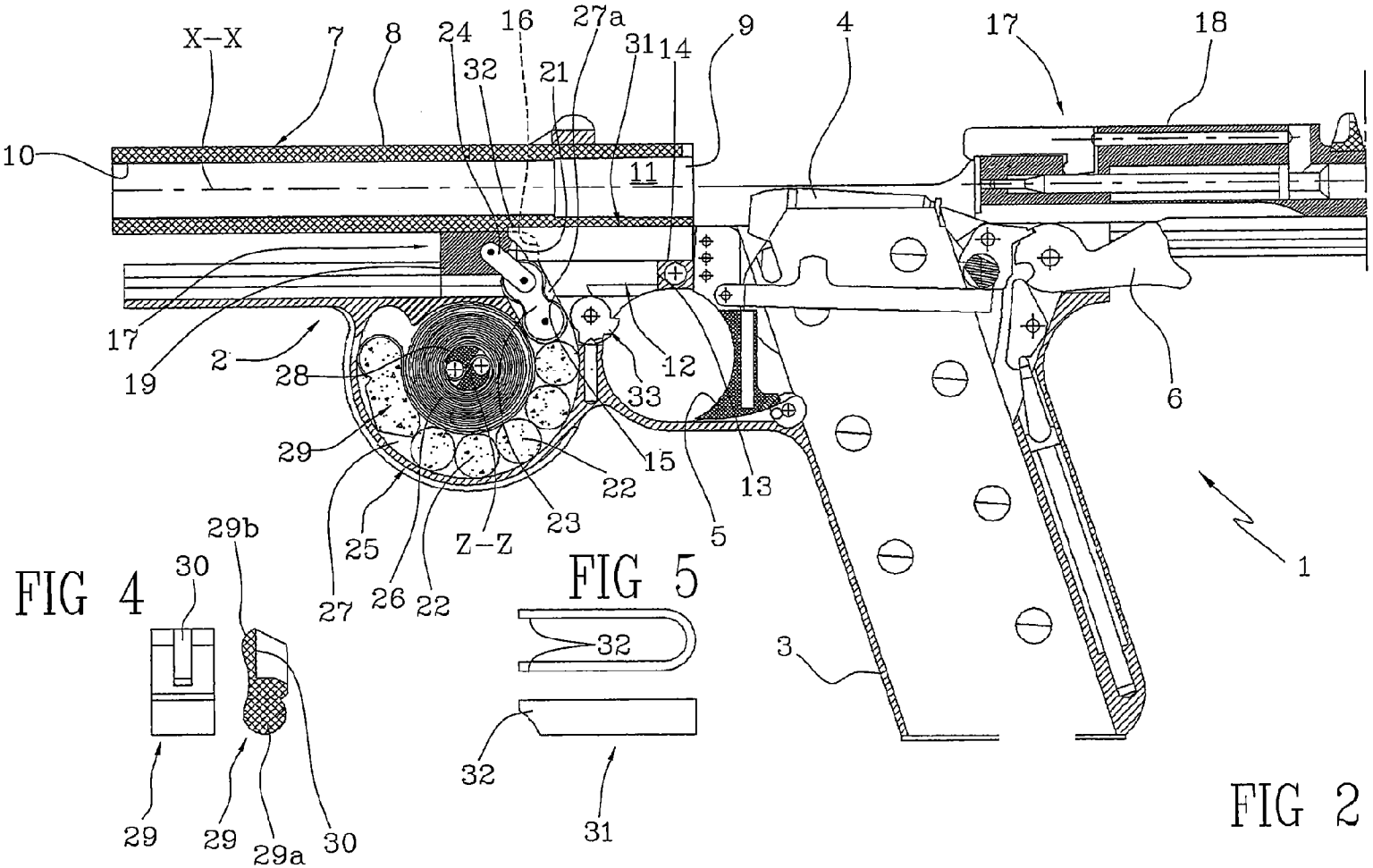
FIG. 2 shows the pistol seen in FIG. 1 in a different operating configuration.
FIG. 4 shows two views of a first detail of the pistol referred to in the previous figures.
FIG. 5 shows two views of a second detail of the pistol referred to in the previous figures.

Mounted on the main body 2 is a barrel 7 comprising a tubular body 8 extending along an axis "X-X". The tubular body 8 is provided with a proximal opening 9 placed in the vicinity of grip 3 and an opposite or distal opening 10. The tubular body 8 confines a chamber 11 close to the proximal opening 9, which chamber is adapted to contain a projectile 4 at a time. Barrel 7 can slide on the main body 2 carrying out a stroke $S_1$ of few millimeters (5 mm-10 mm, for example) between a forward percussion position (FIG. 1) and a backward recoil position (FIG. 2). In addition, barrel 7 comprises a radial portion 12 extending away from the tubular body 8 in the same direction as grip 3. This radial portion 12 has a stop surface 13 facing the grip 3 and a stop element 14 belonging to the main body 2. In the configuration shown in FIG. 1, the distance between the stop surface 13 of the radial portion 12 and the stop element 14 corresponds to the stroke $S_1$. This radial portion 12, on the opposite side relative to the stop surface 13, has a stop plane 15 inclined to a direction orthogonal to the axis "X-X" of barrel 8. The radial portion 12 further has a holding surface 16 alongside the stop plane 15, which too is placed on the opposite side relative to the stop surface 13, close to the tubular body, and is preferably of concave shape.

Pistol 1 comprises a slider 17 mounted on the main body 2. Slider 17 in turn comprises a breechblock 18 aligned with barrel 7 along axis "X-X" and such disposed as to face the proximal opening 9 and an operating portion 19 integral with the breechblock 18 and placed on the side of the tubular body 8. The operating portion 19 is guided in a guide defined in the main body 2, is aligned with the radial portion 12 of barrel 7 along an operating direction "Y-Y" parallel to axis "X-X" of barrel 7 and faces said radial portion 12. Slider 17 can translate on the main body 2 between a forward position, shown in FIG. 1, in which the breechblock 18 closes the proximal opening 9 of barrel 7 and a backward stop position, shown in FIG. 2, in which the breechblock 18 is spaced apart from the proximal opening 9. In the forward position, the operating portion 19 of slider 17 lies spaced apart from the radial portion 12 of barrel 7 and confines a channel 20, together with said radial portion 12 and the main body 2. In the second backward position, the operating portion 19 of slider 17 lies close to the radial portion 12. The operating portion 19 has a preferably concave holding surface thereof turned towards the radial portion 12.

Pistol 1 further comprises a plurality of pushing elements 22 that, as in the embodiment shown, preferably consist of cylindrical rollers disposed mutually side by side at their cylindrical side surfaces. The cylindrical roller train 22, when slider 17 is in the first forward position shown in FIG. 1, is placed in channel 20 and said rollers 22 are mutually aligned along the operating direction "Y-Y" and packed between the holding surface 16 of barrel 7 and the holding surface 21 of slider 17.

In the embodiment shown, the two first cylindrical rollers 22 disposed close to the operating portion 19 of slider 17 are mutually secured by means of a first plate 23 on which they are both hinged around their main axes. These rollers 22 are further secured to said operating portion 19 of slider 17 through a second plate 24 having one end hinged on the first plate 23 and the opposite end hinged on the operating portion 19. The remaining cylindrical rollers 22 (five in number in the pistol shown) are not mutually linked but merely lie side by side.

The main body 2 of pistol 1, on the side of channel 20, comprises a box-shaped body 25 in which a spirally wound tape spring 26 is installed. The main body 2 extends under barrel 7 like grip 3 and in front of trigger 5. A recovery chamber 27 is confined between the tape spring 26 and an outer wall of the box-shaped body 25, which recovery chamber partly extends around said tape spring 26 and is shaped like an arc of a circle (subtending an angle of about 270°). The recovery chamber 27 and tape spring 26 extend around an axis "Z-Z" orthogonal to the operating direction "Y-Y" and preferably orthogonal to a symmetry plane of pistol 1. The recovery chamber 27 has a closed end and an opposite end that is open through an access **27*a* opening into the main body 2 towards barrel 7**, as described in more detail in the following.

An inner end of the tape spring 26 is fastened to a pin 28 mounted on the box-shaped body 25. Rotation of pin around axis "Z-Z" allows adjustment of the tape spring 26, i.e. preload thereof to be regulated. An outer end of the tape spring 26 is fastened to an end pushing element 29 that can slide inside the recovery chamber 27 along a path shaped like an arc of a circle guided, on one side, by the radially outermost turn of said tape spring 27 and, on the other side, by the outer wall of the box-shaped body 25.

The end pushing element 29 comprises (FIG. 4) a hooking portion 29*a* to the tape spring 27 and a thrust portion 29*b* designed to come into contact with one of the cylindrical rollers 22 and the radial portion 12 of barrel 7. The thrust portion 29*b* has a cavity inside which a stop surface 30 is present.

At the radial portion 12 of barrel 7 there is a conveyor 31 that is fixed relative to the main body 2. Conveyor 31 (FIG. 5) is in the form of a fork disposed around said radial portion 12 and its ends 32 are turned towards channel 20. When barrel 7 is in its forward percussion position, these ends 32 are disposed on the sides of the radial portion 12 and do not project inside channel 20. Shown in FIG. 1 is only a portion in section of said conveyor 31. When barrel 7 is in its backward position and the access 27*a* is clear, these ends 32 project inside channel 20 and their shape guides rollers 22 to said access 27*a* (FIG. 2).

Pistol 1 further comprises a lock device 33 placed nearby the access 27*a* and movable between a disengaged position from said access 27*a*, to allow entry or exit of the pushing elements 22, and an engaged position in said access 27*a*, to retain rollers 22 when they are in the recovery chamber 27 and enable disassembling of barrel 7 without rollers 22 falling out. The illustrated lock device 33 is a rotatable element that is operated manually.

In use, when pistol 1 is ready to shoot with a projectile 4 in chamber 11 (FIG. 1), barrel 7 is in its forward percussion position with the stop surface 13 of the radial portion 12 spaced apart from the stop element 14 by the distance $S_1$. The end pushing element closes access 27*a* and the stop plane 15 of the radial portion 12 of barrel 7 bears against the stop surface 30. Said radial portion 12 cooperates with the end pushing element 29*a* for closing said access 27*a*. Slider 17 is in its forward closure position in which the breechblock 18 bears against the proximal opening 9 of barrel 7 (and closes it) and the operating portion is spaced apart from the radial portion 12. All rollers 22 are contained in channel 20 and the roller 22 close to access 27*a* bears partly against the holding surface 16 of the radial portion 12 of barrel 7 and partly against the hooking portion 29*b* of the end element 29*a*.

Just after percussion, by effect of the pressure generated by the bursting gases, barrel 7 and slider 17 jointly move backwards being steadily locked to each other by the train of cylindrical rollers 22 over the first stroke portion $S_1$. The packed rollers 22 constitute a metal closure block enabling maximum exploitation of the bursting gases under expansion. When the first stroke portion $S_1$ has been covered, the stop surface 13 of the radial portion 12 of barrel 7 stops in its backward recoil position against the stop element 14. The stop plane 16 of the radial portion 12 moves away from the stop surface 30 of the end pushing element 29 and clears access 27*a* opening into channel 20. This stop plane 16 is oriented like the access walls 27*a*. The projectile 4 comes out of barrel 7 through the distal opening 10. Rollers 22 are pushed by the operating portion 19 of slider 17 and push the end pushing element 29 into the recovery chamber 27, in turn entering said recovery chamber 27 one after the other being guided by the stop plane 16 and conveyor 31. The end pushing element 29 almost reaches the closed end of the recovery chamber 27. Opening of access 27*a* and entry of rollers 22 therefore disengage slider 17 from barrel 7. Barrel 7 has reached its end of stroke but slider 17 continues its recoil stroke over a portion $S_2$ (50 mm-70 mm) that is much greater than $S_1$. The breechblock 18 moves backwards until the end of its stroke, recocks the hammer and ejects the fired cartridge case. This action is counteracted by the tape spring 26 that during the backward movement of slider 17, is loaded, being pushed by rollers 22.

At this point, the tape spring 26 tends to run down and go back to the starting configuration. The tape spring 26 pushes the end pushing element 29 towards access 27*a* that in turn pushes rollers 22 out of the recovery chamber 27. Rollers 22 push the operating portion 19 of slider 17 towards the forward position and the breechblock 18 towards barrel 7. The breechblock 18, in its forward movement, introduces a new projectile 4 into chamber 11 and goes on until all rollers 22 are again aligned in channel 20 and locked between barrel 7 and slider 17. Then barrel 7 that is no longer retained in the backward position by the alternation of rollers 22 sliding against the stop plane 15, can move forward together with slider 17. The stop plane 15 is inserted into the cavity of the end pushing element 29 and stops against the stop surface 30, thus completing the closure block.

What is claimed is:

1. Short recoil firearm, comprising:

a main body (2);

a barrel (7) comprising a tubular body (8) presenting a proximal opening (9) and a distal opening (10); said barrel (7) being slidingly mounted on the main body (2) and movable between a forward percussion position and a backward recoil position;

a slider (17) slidingly mounted on the main body (2) and movable between a forward position of closure of the barrel (7) and a backward stop position;

elastic means (26) working on the slider (17) to push said slider (17) towards the forward closure position;

characterised in that it comprises a plurality of pushing elements (22) operatively connected to the elastic means (26) and movable between a first configuration, in which they lie mutually side by side along an operative direction (Y-Y) between the slider (17) and the barrel (7), to prevent the relative movement between said barrel (7) and said slider (17) and to allow the integral displacement of said barrel (7) with said slider (17), and a second configuration, in which they lie in a recovery chamber (27) placed on the side of said operative direction (Y-Y); wherein, during the passage from the first configuration towards the second configuration, the displacement of the barrel (7) opens an access (27*a*) for entrance of the pushing elements (22) into said recovery chamber (27), and wherein, during the passage from the second configuration towards the first configuration, the elastic means (26) force said pushing elements (22) towards said first configuration through said access (27*a*).

2. Firearm according to claim 1, wherein said pushing elements (22) comprise a plurality of cylindrical rollers mutually placed side by side on cylindrical surfaces of said rollers.

3. Firearm according to claim 1, wherein the elastic means (26) comprise a spirally wound tape spring connected to an end pushing element (29) operatively connected to said plurality of pushing elements (22); wherein in the first configuration said end pushing element (29) is placed in said access (27*a*).

4. Firearm according to claim 1, wherein the recovery chamber (27) is shaped as an arc of a circle.

5. Firearm according to claim 4, wherein the elastic means (26) comprise a spirally wound tape spring connected to an end pushing element (29) operatively connected to said plurality of pushing elements (22); wherein in the first configuration said end pushing element (29) is placed in said access (27*a*); wherein the recovery chamber (27) partially extends around the tape spring (26).

6. Firearm according to claim 1, wherein an operative portion (19) of the slider (17) slides alongside the tubular body (8) of the barrel (7) and is aligned with and faced to a radial portion (12) of the barrel (7) along the operative direction (Y-Y); wherein the pushing elements (22), at least in the first configuration, are placed between said radial portion (12) of the barrel (7) and said operative portion (19) of the slider (17).

7. Firearm according to claim 6, wherein the elastic means (26) comprise a spirally wound tape spring connected to an end pushing element (29) operatively connected to said plurality of pushing elements (22); wherein in the first configuration said end pushing element (29) is placed in said access (27*a*); wherein said radial portion (12) of the barrel (7) presents a stop plane (15) and the end pushing element (29) presents a stop surface (30); wherein, in the first configuration, the stop plane (15) rests against said stop surface (30).

8. Firearm according to claim 7, wherein the stop plane (15) is inclined with an in/out direction of the access (27*a*), to help entry of the pushing elements (22) in said recovery chamber (27) or exit of the pushing elements (22) from said recovery chamber (27); wherein the pushing elements (22) during passage between the first configuration and the second configuration push against said stop plane (15) keeping the barrel (7) in the backward recoil position.

9. Firearm according to claim 3, comprising an adjusting device (28) operatively working on the tape spring (26) to adjust the preload of said tape spring (26).

10. Firearm according to claim 1, comprising a lock device (33) placed nearby the access (27*a*) and movable between a disengaged position from said access (27*a*), to allow entry or exit of the pushing elements (22), and an engaged position in said access (27*a*), to stop the pushing elements (22) when they are in said recovery chamber (27) and to help disassembling of the arm (1).

* * * * *